US008606390B2

(12) United States Patent
Hjalmarsson et al.

(10) Patent No.: US 8,606,390 B2
(45) Date of Patent: Dec. 10, 2013

(54) SEWING MACHINE HAVING A CAMERA FOR FORMING IMAGES OF A SEWING AREA

(75) Inventors: Anders Hjalmarsson, Granna (SE); Christian Bondesson, Huskvarna (SE); Anders Flygare, Jonkoping (SE); Bjorn Crona, Jonkoping (SE)

(73) Assignee: VSM Group AB, Huskvarna (SE)

( * ) Notice: Subject to any disclaimer, the term of this patent is extended or adjusted under 35 U.S.C. 154(b) by 315 days.

(21) Appl. No.: 12/809,590

(22) PCT Filed: Dec. 19, 2008

(86) PCT No.: PCT/SE2008/051539

§ 371 (c)(1), (2), (4) Date: Mar. 4, 2011

(87) PCT Pub. No.: WO2009/085005

PCT Pub. Date: Jul. 9, 2009

(65) Prior Publication Data

US 2011/0146553 A1 Jun. 23, 2011

Related U.S. Application Data

(60) Provisional application No. 61/009,165, filed on Dec. 27, 2007.

(51) Int. Cl.
*D05C 5/02* (2006.01)

(52) U.S. Cl.
USPC ..... 700/138

(58) Field of Classification Search
USPC ..... 700/138, 136; 112/475.01, 475.02, 112/475.03
See application file for complete search history.

(56) References Cited

U.S. PATENT DOCUMENTS 3,570,426 A 3/1971 Kunes
3,585,950 A 6/1971 Ito
(Continued)

FOREIGN PATENT DOCUMENTS

CA 1081544 A1 7/1980
CA 2515406 A1 8/2004
(Continued)

*Primary Examiner* — Danny Worrell
(74) *Attorney, Agent, or Firm* — Lando & Anastasi, LLP

(57) ABSTRACT

A sewing machine (1) has access to a memory (M) for stitch data and a processor (C) for reading said stitch data and for operating the sewing machine (1) to execute stitches according to stitch data, wherein the sewing machine (1) has a hoop (20) for framing a pattern of the sewing material (2), and for moving the framed pattern in a direction comprising a component of at least one of a first coordinate (x) and a second coordinate (y) and wherein further the processor (C) controls movements of the hoop (20) according to said direction in relation to the position of a needle (5) of the sewing machine and synchronously with the movement of the needle for executing stitches, wherein: —the stretched sewing material (2) is clamped to the hoop (20) for forming a framed pattern in the hoop, —the framed pattern of the sewing material (2) is scanned by means of a camera (10) mounted in the sewing machine (1) and directed towards the sewing material (2) for the purpose of taking pictures of part views of said framed pattern, —said part views are tiled together for forming on a display an image of the pattern framed in the hoop, whereby a coordinate of the image of a display (11) refers to a corresponding coordinate of the pattern framed in the hoop (20).

14 Claims, 2 Drawing Sheets

(56) References Cited

U.S. PATENT DOCUMENTS 3,613,608 A 10/1971 Hinerfeld et al.
3,613,610 A 10/1971 Hinerfeld et al.
3,693,561 A 9/1972 Hrinko, Jr. et al.
3,712,254 A 1/1973 Beamish et al.
3,727,567 A 4/1973 Beazley
3,799,087 A 3/1974 Beamish et al.
3,815,531 A 6/1974 Wurst et al.
3,818,849 A 6/1974 Maddox, Jr.
3,904,890 A 9/1975 Wenrich et al.
3,967,566 A 7/1976 Spiegel et al.
4,051,794 A 10/1977 Herzer et al.
4,073,247 A 2/1978 Cunningham et al.
4,092,937 A 6/1978 Landau, Jr. et al.
4,100,865 A 7/1978 Landau, Jr. et al.
4,104,976 A 8/1978 Landau, Jr. et al.
4,108,090 A 8/1978 Landau, Jr. et al.
4,116,145 A 9/1978 Nicolay
4,133,275 A 1/1979 Herzer et al.
4,154,179 A 5/1979 Arnold
4,160,422 A 7/1979 Barber et al.
4,181,085 A 1/1980 Conner, Jr.
4,185,575 A 1/1980 Brown et al.
4,195,582 A 4/1980 Novick et al.
4,214,540 A 7/1980 Cook
4,221,176 A 9/1980 Besore et al.
4,351,254 A 9/1982 Brown
4,352,334 A 10/1982 Childs et al.
4,359,008 A 11/1982 Newman
4,365,565 A 12/1982 Kawai et al.
4,373,458 A 2/1983 Dorosz et al.
4,373,459 A 2/1983 Dunn et al.
4,391,215 A 7/1983 Sansone
4,393,343 A 7/1983 Angersbach et al.
4,412,498 A 11/1983 Scholl
4,457,246 A 7/1984 Hanyu et al.
4,503,794 A 3/1985 Ishihara et al.
4,507,596 A 3/1985 Angersbach et al.
4,509,443 A 4/1985 Martell et al.
4,513,676 A 4/1985 Martell et al.
4,519,331 A 5/1985 Kosrow et al.
4,526,114 A 7/1985 Martell et al.
4,526,116 A * 7/1985 Mannel ..... 112/475.19
4,555,997 A 12/1985 Tancs
4,557,207 A 12/1985 Turner et al.
4,563,964 A 1/1986 Sjodin
4,622,907 A 11/1986 Kimura
4,648,337 A 3/1987 Mall
4,682,554 A 7/1987 Goto et al.
4,686,917 A 8/1987 Braun
4,706,584 A 11/1987 Senda et al.
4,726,307 A 2/1988 Yamauchi
4,726,309 A 2/1988 Popp
4,742,786 A 5/1988 Hashimoto et al.
4,748,920 A * 6/1988 Stutznacker ..... 112/475.19
4,757,773 A * 7/1988 Nomura et al. ..... 112/470.03
4,781,130 A 11/1988 Badowski
4,794,875 A 1/1989 Noguchi et al.
4,803,937 A 2/1989 Hiramatsu et al.
4,815,406 A 3/1989 Brown et al.
4,834,008 A * 5/1989 Sadeh et al. ..... 112/470.04
4,841,891 A 6/1989 Hashimoto et al.
4,849,902 A * 7/1989 Yokoe et al. ..... 112/470.04
4,860,678 A 8/1989 Skogward
4,867,082 A 9/1989 Sabbioni et al.
4,867,087 A 9/1989 Suzuki et al.
4,932,343 A * 6/1990 Mardix et al. ..... 112/470.07
4,982,677 A * 1/1991 Nomura et al. ..... 112/314
4,995,328 A 2/1991 Tanaka
5,000,105 A 3/1991 Tanaka
5,012,752 A * 5/1991 Murata et al. ..... 112/102.5
5,018,466 A 5/1991 Hasegawa
5,095,835 A * 3/1992 Jernigan et al. ..... 112/475.05
5,138,962 A 8/1992 Klundt
5,146,862 A 9/1992 Sato et al.
5,156,106 A 10/1992 Suzuki et al.
5,156,107 A 10/1992 Kyuno et al.
5,184,560 A 2/1993 Asano
5,270,939 A 12/1993 Goldberg et al.
5,303,665 A 4/1994 Hausammann
5,319,565 A 6/1994 Hausammann et al.
5,323,722 A * 6/1994 Goto et al. ..... 112/102.5
5,347,940 A 9/1994 Hori et al.
5,389,868 A 2/1995 Mikami et al.
5,410,976 A 5/1995 Matsubara
5,474,005 A 12/1995 Yamauchi et al.
5,477,795 A 12/1995 Nakayama et al.
5,537,939 A 7/1996 Horton
5,537,946 A * 7/1996 Sadeh et al. ..... 112/475.03
5,562,059 A 10/1996 Yamauchi et al.
5,571,240 A 11/1996 Yamauchi et al.
5,588,383 A 12/1996 Davis et al.
5,592,891 A 1/1997 Muto
5,603,272 A 2/1997 Takahashi et al.
5,653,186 A 8/1997 Yamauchi et al.
5,701,830 A 12/1997 Muto
5,740,055 A 4/1998 Iwata
5,755,240 A 5/1998 Schonborn
5,791,270 A 8/1998 Mori
5,911,182 A 6/1999 Uyama et al.
5,924,372 A 7/1999 Okuda et al.
5,974,997 A 11/1999 Amburgey
6,032,595 A 3/2000 Okuyama
6,131,526 A 10/2000 Iida et al.
6,135,038 A 10/2000 Okamoto
6,189,989 B1 2/2001 Hirabayashi et al.
6,202,001 B1 3/2001 Muto
6,209,468 B1 4/2001 Marcangelo et al.
6,293,210 B1 9/2001 Freeman et al.
6,321,670 B1 11/2001 Tomita et al.
6,381,818 B1 5/2002 Freeman et al.
6,718,895 B1 4/2004 Fortuna
6,729,255 B2 5/2004 Ton et al.
6,732,668 B2 5/2004 Zesch et al.
6,823,807 B2 11/2004 Zesch et al.
6,871,605 B1 3/2005 Zesch et al.
6,883,446 B2 4/2005 Koerner
6,883,449 B2 4/2005 Burrell et al.
6,963,790 B2 11/2005 Mizuno et al.
6,983,192 B2 1/2006 Block et al.
7,210,417 B2 5/2007 Koerner
7,212,880 B2 5/2007 Mizuno et
7,240,628 B2 7/2007 Friman et al.
7,308,333 B2 12/2007 Kern et al.
7,412,936 B2 8/2008 Price et al.
7,460,925 B2 12/2008 Noguchi
7,793,602 B2 9/2010 Koemer
7,814,832 B2 10/2010 Franz
8,261,679 B2 9/2012 Ihira et al.
8,387,547 B2 3/2013 Bardh et al.
2002/0043202 A1 4/2002 Freeman et al.
2003/0140829 A1 7/2003 Zesch et al.
2003/0140831 A1 7/2003 Zesch et al.
2003/0140832 A1 7/2003 Ton et al.
2004/0210336 A1 10/2004 Block et al.
2005/0016428 A1 1/2005 Koerner
2006/0064195 A1 3/2006 Kern et al.
2006/0213413 A1 9/2006 Koerner
2007/0204781 A1 9/2007 Noguchi
2007/0245940 A1 10/2007 Wahlstrom
2007/0256619 A1 11/2007 Koemer
2010/0224111 A1 9/2010 Ihira et al.
2011/0005441 A1 1/2011 Roche
2011/0041746 A1 2/2011 Eklund et al.
2011/0168070 A1 7/2011 Lanquist
2011/0303138 A1 12/2011 Flygare et al.
2012/0060733 A1 3/2012 Maki et al.
2012/0060734 A1 3/2012 Yamanashi et al.
2012/0234222 A1 9/2012 Naka
2013/0014682 A1 1/2013 Brindzik
2013/0042797 A1 2/2013 Bondesson et al.

(56) References Cited

U.S. PATENT DOCUMENTS

FOREIGN PATENT DOCUMENTS

| | | | |
|---|---|---|---|
| DE | 102007001073 | A1 | 8/2007 |
| EP | 77788 | A1 | 5/1983 |
| EP | 103364 | A2 | 3/1984 |
| EP | 117713 | A1 | 9/1984 |
| EP | 124211 | A1 | 11/1984 |
| EP | 366140 | A1 | 5/1990 |
| EP | 515131 | A1 | 11/1992 |
| EP | 564771 | A2 | 10/1993 |
| EP | 857228 | A1 | 8/1998 |
| EP | 1184502 | A1 | 3/2002 |
| EP | 1777331 | A1 | 4/2007 |
| EP | 2226419 | A1 | 9/2010 |
| GB | 1320764 | A | 6/1973 |
| GB | 1349994 | A | 4/1974 |
| GB | 1375540 | A | 11/1974 |
| GB | 1393294 | A | 5/1975 |
| GB | 1440350 | A | 6/1976 |
| GB | 1475791 | A | 6/1977 |
| GB | 1526209 | A | 9/1978 |
| GB | 1547931 | A | 7/1979 |
| GB | 1547932 | A | 7/1979 |
| GB | 1547933 | A | 7/1979 |
| GB | 1547934 | A | 7/1979 |
| GB | 1568486 | A | 5/1980 |
| GB | 1570241 | A | 6/1980 |
| GB | 1570242 | A | 6/1980 |
| GB | 1570243 | A | 6/1980 |
| GB | 1570244 | A | 6/1980 |
| GB | 1570245 | A | 6/1980 |
| GB | 1571736 | A | 7/1980 |
| GB | 2043124 | A | 10/1980 |
| GB | 1583629 | A | 1/1981 |
| GB | 2157723 | A | 10/1985 |
| GB | 2168085 | A | 6/1986 |
| GB | 2177520 | A | 1/1987 |
| GB | 2204604 | A | 11/1988 |
| JP | 1212591 | A | 8/1989 |
| JP | 02055080 | A | 2/1990 |
| JP | 6304359 | A | 11/1994 |
| JP | 2000167277 | A | 6/2000 |
| JP | 2000342869 | A | 12/2000 |
| JP | 2009011594 | A | 1/2009 |
| JP | 2009233435 | A | 10/2009 |
| JP | 2010185151 | A | 8/2010 |
| KR | 198800714 | B1 | 4/1988 |
| WO | 8901067 | A1 | 2/1989 |
| WO | 9715708 | A1 | 5/1997 |
| WO | 0104405 | A1 | 1/2001 |
| WO | 2004072349 | A2 | 8/2004 |
| WO | 2006071786 | A2 | 7/2006 |
| WO | 2007143062 | A2 | 12/2007 |
| WO | 2010144013 | A1 | 12/2010 |

* cited by examiner

SEWING MACHINE HAVING A CAMERA FOR FORMING IMAGES OF A SEWING AREA

TECHNICAL FIELD

The present invention relates to a sewing machine provided with a camera. The camera is used for forming images of a sewing area. The invention is also directed to the method for providing said images and to applications of said method to facilitate sewing.

BACKGROUND ART

It is known that embroideries can be executed by means of a sewing machine, wherein the embroidery is stored in a memory that contains stitch data for the embroidery. An operator selects, for example, an embroidery from the memory and places a sewing material, on which the embroidery is to be executed, stretched or clamped onto an embroidery hoop [hereinafter referred to as "hoop" only] which is arranged in the sewing machine in such a way that a control program for the sewing machine mechanically moves the hoop in accordance with a control program and stitch data when executing the embroidery on the sewing material. The sewing material is usually a fabric, which concept will be used hereinafter as an example to designate all types of sewing materials.

When embroidering or sewing on a fabric in a sewing machine, it is common practice to start the embroidery or the seam from a certain desired position. Thus, it may, for example, be desirable for the first stitch in the embroidery or the seam to start from a feature which already exists on the fabric. Such a feature may consist of an already existing embroidery element, a certain seam, a certain ornamental element such as a pearl, a print, etc. Positioning the embroidery or seam in question in such a desired position may be difficult, especially if such an adaptation is desired with very high precision. If an operator wishes to correctly place, for example, an embroidery element on a fabric to a specific position, this may be done by carefully moving the fabric being clamped in a hoop, and during the whole sewing process manually actively synchronize the position of the fabric with a corresponding position in the processor of the sewing machine. Other issues of interest when using a hoop is, e.g. for a user to have an idea about how parts of an embroidery are related to each other.

A drawback in the use of sewing machines provided with a display is that no method and adherent devices exist to show on the display an undistorted picture of the full work area such as, for example, the work area of a fabric clamped in a hoop. As will be understood from the description below such assistance would be a valuable support in performing different applications on a sewing machine of the kind.

One solution to the difficulty of correct positioning is shown in document DE 19921130. The document discloses a method in which an embroidery is to be placed at a given position on a fabric. The fabric wears machine-readable symbols which indicate where the embroidery is to be placed. Each such symbol is detected by a sensor that performs readings, where these readings are transformed into position data which are used by the sewing machine for placing the embroidery pattern at the given place. The fabric is initially provided with printing containing said symbols. The symbols contain an optical fluorescent material. The sensor is a light-detecting scanner. A disadvantage of such a method is that it cannot, of course, be used on fabrics that have not been provided initially with pre-print containing position determinations.

Machine vision is a field of technology that is being increasingly used in industry and which also starts to be used in certain consumer products. This means that images are captured with a camera, to which image-processing algorithms are then applied in order to obtain certain desired information, often as to where an object is situated, if it has the correct appearance, how many objects there are, etc.

A machine vision system is disclosed in document US 2006/0015209. Said document discusses the use of a camera in a sewing machine to ensure a problem-free operation of the sewing machine. This is solved by utilizing a camera for monitoring sewing machine elements and thereby assist a user with respect to the proper use of sewing machine elements.

DESCRIPTION OF THE INVENTION

It is an object of the present invention to present a method and a device for providing in a sewing machine an image of a sewing area of a fabric, wherein the coordinates of the image refer to corresponding coordinates of the sewing area.

It is a further object of the present invention to suggest a method and a device for coordinating predetermined positions in a simple manner, for example positions for seams or embroidery elements on a fabric, with corresponding positions stored in an electronic memory for display on a screen.

According to the objects of the invention there is provided a sewing machine with a vision system, which consists of a normal embroidery machine with a small built-in camera that is used for different purposes simplifying and enhancing the sewing. The camera is as small as possible, built-in, e.g., to an extent where it is barely noticeable.

According to one aspect of the invention, a method is presented which has the characteristic features according to claim 1.

Another aspect of the invention is presented in the independent device claim.

Additional embodiments of the invention are illustrated in the dependent claims.

According to the aspects of the invention the sewing machine has access to a memory for stitch data and a processor for reading said stitch data and for operating the sewing machine to execute stitches according to stitch data, wherein the sewing machine has a hoop for framing a pattern of the sewing material, and for moving the framed pattern in a direction comprising a component of at least one of a first coordinate (x) and a second coordinate (y) and wherein further the processor controls movements of the hoop according to said direction in relation to the position of a needle of the sewing machine and synchronously with the movement of the needle for executing stitches, wherein:

- the stretched sewing material is clamped to the hoop for forming a framed pattern in the hoop,
- the framed pattern of the sewing material is scanned by means of a camera mounted in the sewing machine and directed towards the sewing material for the purpose of taking pictures of part views of said framed pattern,
- said part views are tiled together for forming on a display an image of the pattern framed in the hoop, whereby a coordinate of the image of the display refers to a corresponding coordinate of the pattern framed in the hoop.

As mentioned, during embroidery according to the inventive aspect, the movements of the fabric is controlled, by means of the processor, by an auxiliary member to pass the fabric in at least one of the directions of a first coordinate and a second coordinate, where said auxiliary member in the following is exemplified by a hoop in which the fabric, is clamped. In general, an embroidery unit being a part of the sewing machine is utilized specifically for embroidery, where said hoop constitutes part of the embroidery unit, to move the fabric. The sewing machine controls the hoop in two directions, defined by said coordinates, with the aid of the embroidery unit, for example in an x-direction and a y-direction, by means of stepping motors, one for each direction. An embroidery unit controls the movements of the hoop according to data for the coordinates of the stitches stored in a memory available to the sewing machine.

A considerable problem when reading in the hoop may be uneven light. It is important that the camera is adjusted in the best way in order to manage variations of the light. It is also important that the light environment in the sewing machine should be designed to fit the camera. In one embodiment the light is arranged to change automatically to camera mode when the hoop is scanned and for other operations with the camera. The reason for this is to obtain as uniform a result as possible from time to time and for any compensation to correspond as well as possible.

It is possible to inspect certain areas of the pattern in the hoop more carefully. In such cases, the embroidery unit is run to position the hoop in the desired position and a new part view image is taken. By having the image taken with the most important part in the middle, it is possible to position objects on the pattern with greater precision. Both the system and the user may decide that these special inspections need to be done.

There are several different ways to use image processing to compensate for the geometrical distortion and uneven light. The part views have to be tiled together. Embodiments for achieving this are described below. It is sufficient to accomplish an image of the pattern, where the system can carry out an image analysis on it.

For rotatable hoops, reasonably only half the hoop may be scanned at a time.

The image of the hoop should also be capable of being transferred to external computer software, and it should be possible to order special inspections by use of said external computer.

The camera can, according to one embodiment, be aligned such that its optical axis coincides with the point of intersection of the needle with the sewing material under the assumption that the needle is not in a position where it is deflected from its normal running direction, that is, the axis along which the needle is running, when it is designed to carry out a straight stitch.

The invention comprises a sewing machine for carrying out the method of positioning a seam or an embroidery element in relation to attributes on a pattern according to the method of claim 1, where said sewing machine is equipped with said camera and said screen, on which an image of the pattern may be shown.

The term pattern is herein used as a reference to what is visible in the hoop. Thus, the term pattern includes, as some examples, a uniformly coloured sewing material framed in the hoop, a designed sewing material framed in the hoop, as well as a sewing material provided with one or several appliqués.

In relation to the prior art, an operator, when using the method according to the aspects of the invention, is provided with means for accomplishing a better compliance between coordinates of the image of the pattern in the hoop and the coordinates of the actual pattern in the hoop. Some examples of actions where this is an advantage are:

transforming an image of a design residing on the display to the fabric in the hoop by executing stitches during preservation of the inter-related coordinates of the image, automatically translating and rotating an embroidery part so it fits with a previous embroidery part stitched on the pattern in the hoop, automatically finding the edges of an appliqué and thereby being enabled to sew it correctly in the desired position in the pattern, a possibility of finding in the pattern edges, seams, lines and curves along which the sewing machine is ordered to stitch, a possibility of drawing seams and/or marking stitches directly on the display, or in software of the sewing machine, being assured of that the drawn or marked objects will be positioned on the corresponding coordinates on the pattern of the hoop.

The scanning of the pattern could also be used to observe how stitches have moved in the hoop during the execution of a sequence of stitches and to use this information for transforming upcoming stitches in a way so that early and late stitches in the sequence of stitches are well aligned. A common problem is that the stitches executed pull the fabric together, a circumstance which results in a displacement of stitches. This can sometimes cause very obvious miss-alignment between different colors in the embroidery. To achieve alignment the picture of the pattern is analyzed (scans are performed regularly). By comparing an actual picture of the executed stitches and the picture of the pattern before the sewing with a target pattern a transformation equation is derived for use on the upcoming stitches. This transformation equation makes the upcoming stitches end up correctly in relation to the earlier stitches.

DETAILED DESCRIPTION OF EMBODIMENTS

In the following, a number of embodiments of the invention will be described with reference to the accompanying drawings.

Figure 1:
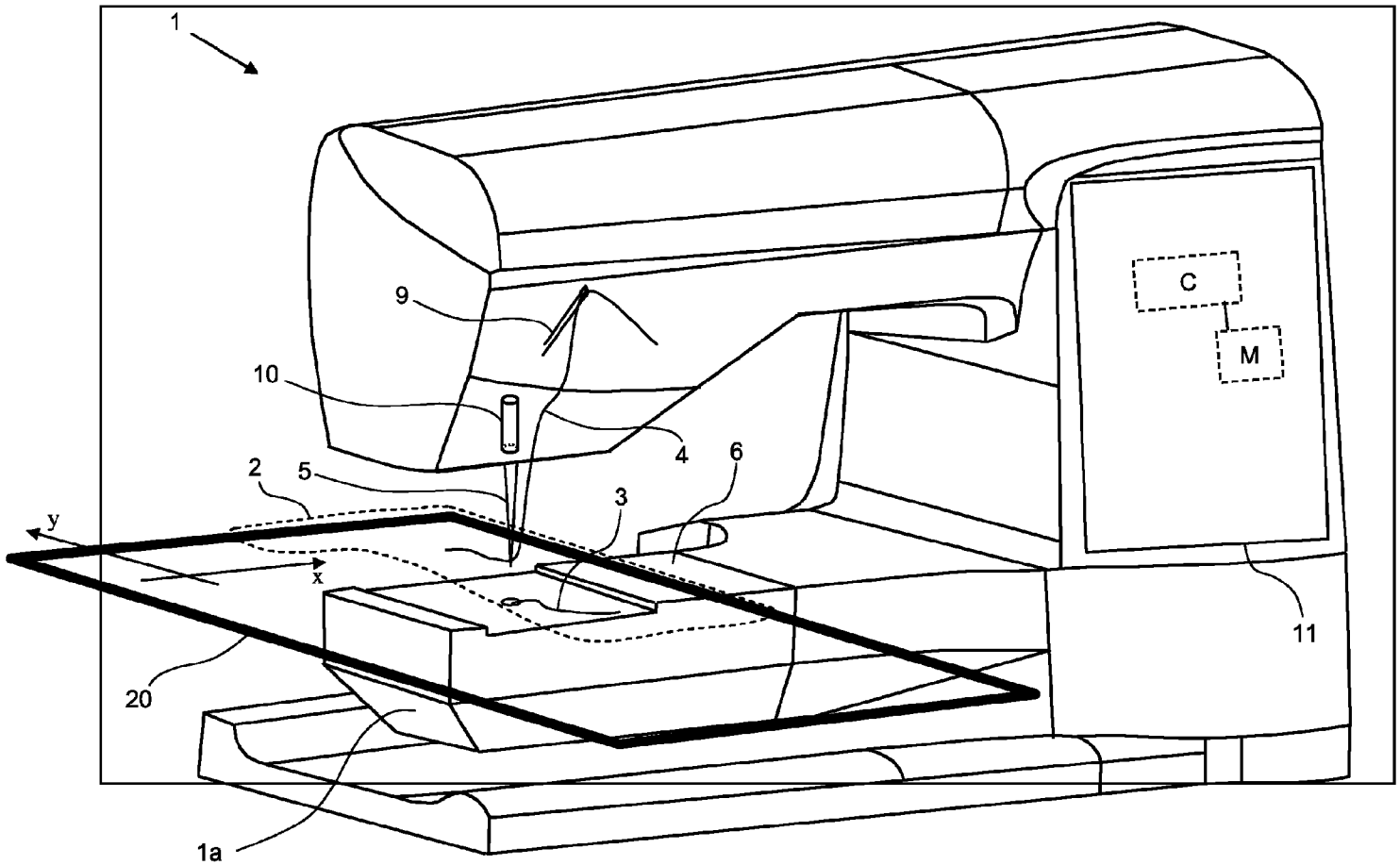
FIG. 1 shows an outline sketch of a sewing machine with a hoop mounted therein and a control member for controlling the hoop.

As an example of the function of a sewing machine for carrying out the method according to the invention, FIG. 1 shows an embroidery sewing machine, in which according to the example a sewing machine of the lockstitch type is used for executing stitches in a desired embroidery, in which in a known manner a stitch 2 is moved forwards between a lower thread 3 and an upper thread 4 for executing a seam that is built by desired stitches by means of a needle 5 that is periodically passed through the fabric 2. In the example, the fabric 2 is passed over a sewing table 6 which also houses a lower bobbin designed for the lower thread 3 and enclosed in a shuttle in a known way (not shown) in a lower arm 1*a* of the sewing machine. The upper thread 4 is passed via a take-up lever 9, which by means of an upward and downward cyclic movement achieves, under the fabric 2, a loop on the upper thread 4, when the needle 5, through the eye of which the upper thread 4 is running, has passed the upper thread through the fabric 2 and the take-up lever 9 again moves upwards from its lowermost position. A shuttle arm (not shown) of the shuttle hooks into said loop when the shuttle rotates cyclically in synchronization with the needle. For executing a stitch, in this case a lockstitch, the needle 5 is passed in a reciprocating movement, substantially in a direction that is normal to the fabric 2, such that the needle 5 passes the upper thread 4 down through the fabric 2, after which the shuttle passes the upper thread 4 around a bobbin that houses the lower thread 3, thus achieving a knot in the fabric 2, when the needle 5 has been passed up through the fabric and the take-up lever 9 tightens the knot in the stitch.

According to known technique, the machine is associated with a control program which, for example, is stored in a processor C. The sewing machine also has an available memory M, which is preferably arranged in the sewing machine but which may also be provided externally and be accessible from the processor C. In the memory M of the sewing machine 1 there is a possibility, when the sewing machine is used for embroidering, of storing sewing elements for embroideries in the form of stitch data for one or more such sewing elements.

FIG. 1 also shows a hoop 20 arranged in the sewing machine, where a piece of fabric 2 is clamped in the hoop. The piece of fabric 2 is only symbolically shown in the figure as covering only part of the hoop and made with dash-lined contours to render the devices more illustrative. The hoop 20 is fixed to a first feeding device controlled by a first stepping motor (not shown) that operates the hoop in an x-direction, where this x-direction according to the example substantially coincides with the longitudinal axis of the sewing machine. In a corresponding manner, the hoop 20 is attached to a second feeding device controlled by a second stepping motor (not shown) that operates the hoop in a y-direction, where this y-direction according to the example is perpendicular to the x-direction and coincides with the sewing direction, that is, in the direction in which the needle executes a seam on the fabric 2, when no lateral deflection of the seam is requested. By controlling the stepping motors by means of signals from the processor C, the hoop 20, with the clamped piece of fabric, may be operated to a movement in an optional direction in the xy-plane. The movements are achieved by means of an embroidery unit which is not shown in its entirety since such a unit belongs to the prior art and does not form part of the present invention. The embroidery unit comprises said stepping motors and feeding devices for the hoop 20, which in a suitable manner is connected to the embroidery unit and it's feeding.

When performing conventional embroidery in an embroidery machine of this kind, the machine controls the embroidery unit completely according to stitch data stored in the memory of the sewing machine according to all aspects, with regard to types of stitches, directions of sewing etc according to the prior art.

According to the invention, a camera 10 is mounted in the sewing machine. The camera 10 is suitably mounted near the needle 5 and preferably arranged so as to be directed towards an area of the fabric 2 around the needle 5. Thus, the camera 10 can make an image of the fabric 2 and forward the image of the fabric 2 to a screen 11 for displaying the imaged fabric on the screen 11. The screen 11 is preferably arranged on the front of the sewing machine 1 but may, of course, constitute a separate screen or any other connected display.

Since a cameras field of view only covers a small part of the hoop, several pictures of the hoop has to be tiled together to form one picture of the content in the hoop. To capture the tiles the embroidery unit is moved in certain steps and a picture is taken for each step. One way to capture the image of the pattern in the hoop is to take the pictures in a matrix manner, wherein the part views are the elements of the matrix.

The presser foot will cover a bit of the top centre part of the tile image. The top rows of the pictures will not be used when capturing the hoop for this reason. But when the tile pictures in the top part of the hoop are taken, it is necessary to use these rows. The part view where the presser foot is visible will then be cut and replaced with the corresponding hoop area from the next tile picture. This means that the first row of tile pictures will have to be taken more closely to each other than for the rest of the hoop.

The tiles are corrected for geometrical distortion and uneven light, and then they are pasted into a large picture that combines all tiles into one picture of the content in the hoop.

The Tiling Process

To know which hoop coordinates each pixel refers to we first need to know at what distance from a specified origin each pixel is. The specified origin could e.g. be the needle down position, that is the point where the needle penetrates the fabric. Once the distance from the origin is known, this position is added to the embroidery unit's position to result in the correct hoop coordinate. There are different ways to learn each pixel's distance from the origin.

The process of tiling part views is done successively. The part views are tiled into the combined image as the respective part view is shot by the camera. The position of the hoop when the picture of the part view (the tile picture) is shot is used as a set-off value for the part view's origin. The combined image is an empty matrix to begin with. For each tile picture a specified part of the combined image (an element of the matrix of part views) is filled pixel by pixel with RGB-values from the tile picture.

To get the coordinate value of a specific pixel in the tile picture either a table or an equation is used. The coordinate value could come from one specific pixel or a combination of several pixels. The table or equation that is used for finding correct positions in the tile pictures is made from measurements on how pixels in the tile pictures relate to exact coordinates in the hoop and is designed to compensate for geometrical distortion. By using the table or equation and the set-off value depending on the hoop's position when the picture was shot, the part views will align virtually perfect in the combined image.

A way to compensate for the geometrical distortion is to graphically show the hoop coordinates and then photograph them to evaluate how well they correspond to the camera's coordinates. This method not only compensates for geometrical distortion but can also compensate for the camera being not perfectly perpendicular to the hoop. In the method the hoop coordinates are visualized by dots with a known distance to each other. One way of doing that is to print out the dots and attach the printed paper (or fabric) to the hoop and make sure that it is not rotated. Another way is to have a fabric where needle holes stay visible and let the needle make the dots. In that case the position of the needle holes will be perfect but when interpreting them as dots there might be small deviations.

After the picture of the dots has been taken, the dot positions are automatically analyzed to find where in the picture they are and what hoop coordinates they correspond to. To minimize the impact of small deviations when detecting the dots an average of many reference pictures should be used. This is more effective than using extremely many dots in the reference picture. From this a polynomial equation can be calculated. This equation is used for each pixel in the compensated picture to tell where it is positioned in the original picture. Several different kinds of polynomial equations could be used. This is prior art technology being used e.g. in geometrical correction of satellite photos, whereby details of said equations are not further described herein.

Instead of calculating the equations for all pixels in every picture, a matrix could be constructed that tells at which positions in the original picture to find the RGB-values that result in a geometrical corrected image. That is a solution which will significantly reduce computing but on the expense of more memory, in this case it is preferable to increase memory usage.

Figure 2A:
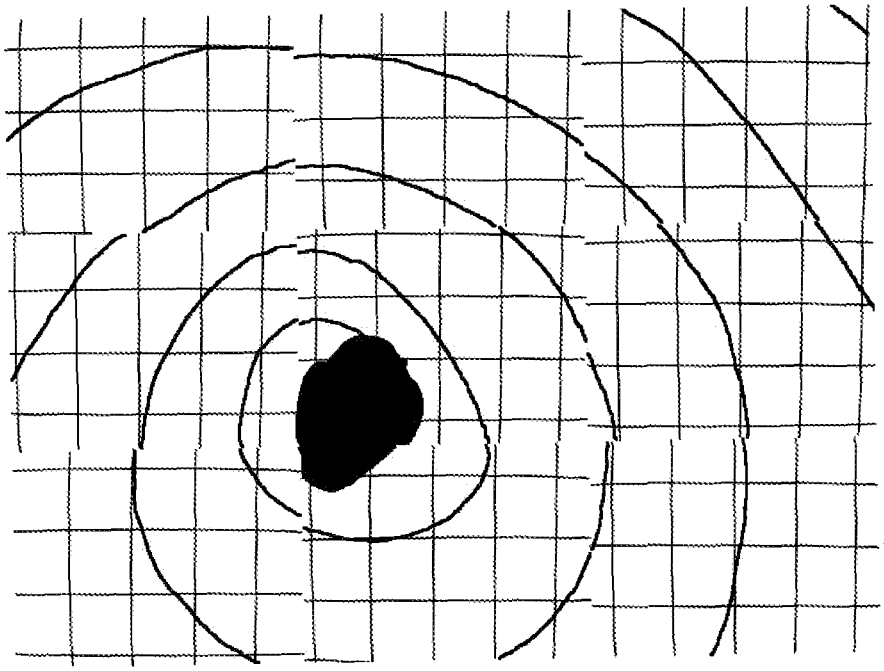
FIG. 2*a* shows part views of the pattern of the hoop, wherein the part views describe the situation without correction of geometrical distortion.
Figure 2B:
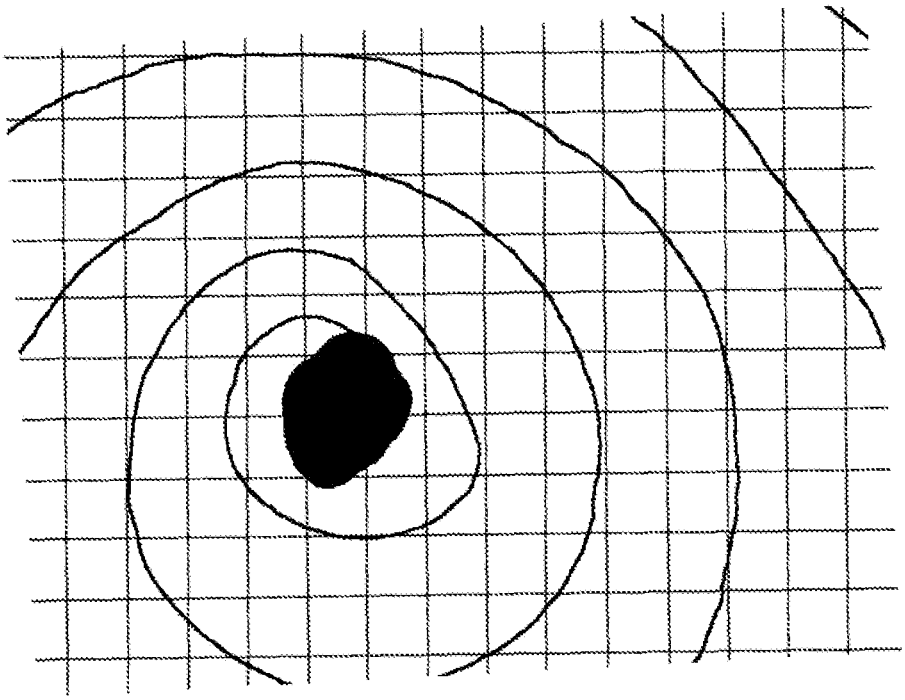
FIG. 2*b* shows the part views after tiling and corrections.

FIG. 2*a* shows a combined picture being an example of how it would look when nine part views are tiled together without geometrical correction. The border between the part views are very distinct since lines between two part views don't match at the borders. A sewing pattern is further indicated in the picture as a helical curve. FIG. 2*b* shows the same nine part views but after they have become tiled together by use of geometrical correction, which makes the combined picture to appear as one big picture instead of a combination of several smaller pictures. The sewing pattern is now without breaks.

To just measure the distances of a few pixels from the origin and assume that the system is linear will result in a very inaccurate system, and the combined picture of the hoop will have very visible tiles. This is because the distance from the camera to the fabric is much greater in the corners of the picture. The described tiling method even makes it possible to have a camera that isn't perpendicular to the hoop.

A certain hoop coordinate will most likely correspond to a position that lies somewhere between four pixels. One way to solve that is to take the nearest pixel—nearest neighbour. Another way is to take a weighted mean of the four pixels—bilinear interpolation.

The reason behind geometrical distortion is mainly that the distance to the lens is greater at the periphery than in the centre of the picture. Therefore the same distance will appear shorter at the edge of the picture than in the centre. There can also be flaws in the lens that causes geometrical distortion.

Something that isn't geometrical distortion but causes the same problems is irregularities in the fabric. Mainly, this is due to fabric not being stretched enough in the hoop. The geometrical correction is designed for fully stretched fabric. If this isn't the case then the correction will not lead to best possible results. Another problem is if the fabric has another distance to the camera than the distance in the compensation. This could be because of different hoop types, thick fabric or that the inner frame of a hoop isn't pressed as far down as possible. When having hoops of very different height, different compensations corresponding to different hoops should be used.

The brightness varies over the tile picture. This is because of a combination of the photographical phenomena vignetting and uneven illumination from the sewing machine's LEDs.

To make each tile image look good and fit naturally with other tiles a photometric correction is done which makes e.g. a background color the same for each pixel.

Even though the tiles are compensated, small differences can sometimes be visible by the tile borders. The differences are mostly due to different illuminations but can to some extent also occur because of small geometrical shifts. This problem can be made less visible by having an overlap area where a pixel corresponding to a specific point on the pattern is a combination from two neighbouring tiles.

When capturing the hoop, the memory size, in combination with the hoop size, is the factor which determines if a border can be perfectly detected directly or if another scan with higher resolution at interesting places is needed. According to one example, the sewing machine is built with enough memory to perform 20 pixels per mm capture if a lower resolution is used it might result in a need for extra scans.

Use of Two Cameras

With the suggested camera position the whole stitchable area of the hoop will be captured. It will also be possible to capture the area all the way to the sides and also a small part of the hoop itself on the sides and at the bottom. But at the top there will be a little part of the fabric that can't be captured. This isn't a problem for all the applications, but when the content of the hoop is shown on the sewing machine's display it would look nice if the whole content was there, including non stitchable areas. A solution to this is to use two cameras; the second camera should then be placed behind the presser foot bar. In this way the second camera can capture the top part of the hoop. The application of two cameras can also be a way to perform the scans faster, detect height differences in the fabric and to detect stitches that becomes visible behind the presser foot.

An alternative solution is to only show the stitchable part of the hoop on the display.

Calibration

When mounting the camera on the sewing machine, only the smallest of variations will lead to pixels capturing other coordinates than intended. Since it will be hard to make the mounting process exact it is important to calibrate the camera. In a calibration mode the camera will look for known details such as specific areas of the stitch plate to see which pixels they correspond to. From this information, a calculation is performed to detect the exact position of the camera and which angle it has to the hoop. From that information it is possible to recalculate the equations/pixel map that tells which coordinates the cameras pixels corresponds to.

To go from analogue values in the image sensor to sending a digital image requires quite much processing. This is something that can be done in the cameras microprocessor as well. Often the processing also includes different corrections. One embodiment is to have some of the correction algorithms directly in the cameras microprocessor. This would speed up the image capturing process in some cases.

Examples of Use of the Invention

This invention can be used to align two different embroideries or one embroidery design that is split into several pieces. If the fabric is re-hooped in such a way that some of the earlier stitches are visible, the sewing machine can detect these stitches, from an image of the pattern in the hoop according to the invention, and move and rotate the next (upcoming) part of the embroidery so that the pieces will fit perfectly together. The detected stitches could be part of the design or be extra stitches made only for the system to detect when re-hooping the fabric. Two points are chosen to move and then rotate the upcoming embroidery to align with the part already sewn.

To an image of the hoop residing on the display of the sewing machine a new design may be added, either as a user's composition or one or more embroidery elements uploaded from a memory. The so amended image on the display may now be transformed to a new pattern on the fabric in the hoop by executing stitches according to the image residing on the display during preserving the inter-related coordinates of the pixels of the image on the display.

With known technology for line and edge detection it is possible to use the present invention to automatically find lines and edges to sew upon or next to. An example can, e.g., be an appliqué that is attached to a fabric automatically or a seam that will follow a line drawn on the fabric. In addition to that, the sewing machine can place stitches automatically. A natural consequence upon use of the invention is that the user of the sewing machine manually can indicate stitches to be performed in relation to attributes on the sewing material, both on a built-in display, an external display and in an external software program.

This application of the invention can be used in order to sew with seam allowance along an edge if the fabric may be placed in a hoop. It will further be possible to find and sew along seams or lines which may be drawn on the fabric or may already exist on the fabric. Different line colours or types may be sewn with different colours or seams.

The hoop pattern is captured to an image according to the invention and then edges may be found more or less automatically. The user may assist by means of the display to show where the desired edge is.

Definitions

A stitch consists of the thread between two consecutively laid knots of upper thread and lower thread.

By seam is meant a sequence of stitches.

Attributes, or appliqués, in connection with the present text relate to an object of any kind on the fabric and may consist of a certain fabric, a certain fabric color, or a certain point on an already existing embroidery element, a pearl, a piece of jewellery, a point on another type of decoration or other corresponding ornamental features.

The invention claimed is:

1. A method in a sewing machine that has access to a memory for stitch data and a processor for reading said stitch data and for operating the sewing machine to execute stitches according to stitch data, wherein the sewing machine has a needle that is passed in a reciprocating movement along substantially a normal to a sewing material, and a hoop for framing a pattern of the sewing material, and for moving the framed pattern in a direction comprising a component of at least one of a first coordinate and a second coordinate and wherein further the processor controls movements of the hoop according to said direction in relation to the position of the needle and synchronously with the movement of the needle for executing stitches, wherein the method is characterized by the steps of:

clamping the stretched sewing material to the hoop for forming a framed pattern in the hoop, and scanning the framed pattern of the sewing material by means of a camera mounted in the sewing machine and directed towards the sewing material by taking pictures of part views of said framed pattern, tiling said part views together for forming on a display an image of the pattern framed in the hoop, wherein a coordinate of the image of the display refers to a corresponding coordinate of the pattern framed in the hoop.

2. The method according to claim 1, wherein the method further includes the steps of:

determining an origin of the hoop coordinates of the pattern framed in the hoop, and synchronising an origin of the image coordinates with said origin of the hoop coordinates by setting a first image position of the image coinciding with said origin of the hoop coordinates to be the origin of the image coordinates.

3. The method according to claim 2, wherein the method further includes the steps of:

specifying dots of the pattern framed in the hoop, wherein the distance separating said dots are known, linking a second position of the image to a specific dot of said specified dots of the pattern, calculating the distance between said origin of the image coordinates and said second position, determining the coordinate of said second position of the image, and performing said determination of a coordinate of said second position for an arbitrary number of said specified dots.

4. The method of claim 3, further including one of the steps of:

assigning a specific pixel of the image to represent said first position, and assigning a weighted value of a group of pixels of the image to represent said first position.

5. The method of claim 3, further including one of the steps of:

assigning specific pixels of the image to represent said determined second positions, and assigning a weighted value of a group of pixels of the image to represent said determined second positions.

6. The method of claim 3, further including the steps of:

tiling said part views together for forming on a display an image of the pattern of the hoop, using the position of the hoop when a picture of one of the part views is shot as a set-off value for the origin of the image, arranging each part view to become an element of a matrix forming the image of the hoop, and filling each said element pixel by pixel, wherein each pixel has the coordinate value from each respective picture forming the part view.

7. The method of any one of claims 1-6 for performing the step of:

positioning automatically and precise an embroidery element or an appliqué to the pattern in the hoop, whereby said embroidery part or appliqué is automatically translated and rotated so it fits with a previously embroidered part stitched on the pattern in the hoop by use of recognizing at least two stitches in the image of the pattern in the hoop.

8. The method of any one of claims 1-6 for performing the step of:

detecting in the image of the pattern any of the hoop pattern edges, seams, lines, and curves along which the sewing machine is ordered to execute stitches.

9. The method of any one of claims 1-6 for performing the step of:

automatically finding on the image of the pattern in the hoop the edges of an appliqué attached to the pattern and thereby enabling the sewing machine to sew the appliqué correctly in the detected position of the pattern.

10. The method of any one of claims 1-6 for performing the step of:

transforming an image of a design residing on the display to the fabric in the hoop by executing stitches on the pattern in the hoop on coordinates corresponding to the display coordinates of said image.

11. The method of any one of claims 1-6 for performing the steps of:

drawing seams or marking stitches directly on the display or in software of the sewing machine, and executing said drawn seams or marked stitches on the pattern of the hoop on coordinates corresponding to the display coordinates of said drawn seams or marked stitches.

12. The method according to claim 1, further comprising the steps of:

scanning, during sewing a sequence of stitches, the pattern of the hoop to compare a target pattern with an actual pattern for determining misalignment of stitches, using a transformation equation to compensate for said misalignment in upcoming stitches of said sequence.

13. A sewing machine comprising:

a display, a memory having stitch data, a processor constructed and arranged to read the stitch data and operate the sewing machine to execute stitches according to the stitch data, a needle that is passed in a reciprocating movement along substantially a normal to a sewing material, a hoop for framing a pattern of the sewing material and for moving the framed pattern in a direction comprising a component of at least one of a first coordinate and a second coordinate, the processor further constructed and arranged to control movement of the hoop according to said direction in relation to the position of the needle and synchronously with the movement of the needle, at least one camera constructed and arranged to take pictures of at least part views of a pattern in the visible area of the sewing material framed in the hoop, the camera further constructed and arranged to scan the framed pattern by taking pictures of part views of the framed pattern, the processor further constructed and arranged to tile said part views together to form on the display an image of the pattern framed in the hoop, the image having coordinates that correspond to coordinates of the pattern framed in the hoop.

14. The sewing machine of claim 13, wherein the sewing machine has two cameras.

* * * * *

UNITED STATES PATENT AND TRADEMARK OFFICE

CERTIFICATE OF CORRECTION

PATENT NO. : 8,606,390 B2
APPLICATION NO. : 12/809590
DATED : December 10, 2013
INVENTOR(S) : Hjalmarsson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 565 days.

Signed and Sealed this
Twenty-second Day of September, 2015

Michelle K. Lee

Michelle K. Lee
*Director of the United States Patent and Trademark Office*